US006612898B1

(12) United States Patent
Ohmi et al.

(10) Patent No.: US 6,612,898 B1
(45) Date of Patent: Sep. 2, 2003

(54) METHOD FOR FORMING OXIDATION-PASSIVE LAYER, FLUID-CONTACTING PART, AND FLUID FEED/DISCHARGE SYSTEM

(75) Inventors: Tadahiro Ohmi, Miyagi-ken (JP); Takahisa Nitta, Tokyo (JP)

(73) Assignees: Tadahiro OHMI, Miyagi-ken (JP); Kabushiki Kaisha UltraClean Technology Research Institute, Tokyo (JP)

( * ) Notice: Subject to any disclaimer, the term of this patent is extended or adjusted under 35 U.S.C. 154(b) by 0 days.

(21) Appl. No.: 09/202,105

(22) PCT Filed: Jun. 20, 1997

(86) PCT No.: PCT/JP97/02132

§ 371 (c)(1),
(2), (4) Date: May 14, 1999

(87) PCT Pub. No.: WO97/48834

PCT Pub. Date: Dec. 24, 1997

(30) Foreign Application Priority Data

Jun. 20, 1996 (JP) ..... 8/160323

(51) Int. Cl.[7] ..... C23C 8/10; C23C 8/12; B32B 15/04

(52) U.S. Cl. ..... 448/280; 428/472.2; 428/629; 428/472.1; 148/286; 148/285; 148/289

(58) Field of Search ..... 429/472.1, 472.2, 429/629; 148/280, 286, 285

(56) References Cited

U.S. PATENT DOCUMENTS 4,266,987 A * 5/1981 Wang
5,226,968 A * 7/1993 Ohmi et al.
5,259,935 A * 11/1993 Davidson
5,531,837 A * 7/1996 Ohashi et al.
5,580,398 A * 12/1996 Ohmi
5,672,436 A * 9/1997 Tobin
5,817,424 A * 10/1998 Ohmi
5,951,787 A * 9/1999 Ohmi et al.

FOREIGN PATENT DOCUMENTS

| | | | |
|---|---|---|---|
| JP | 54-116346 | 10/1979 | ..... C23F/7/04 |
| JP | 3/500550 | 2/1991 | ..... C23C/8/36 |
| JP | 07180001 A | 7/1995 | ..... C22C/38/00 |
| JP | 07331409 A | 12/1995 | ..... C23C/8/14 |

* cited by examiner

*Primary Examiner*—Deborah Jones
*Assistant Examiner*—Jason Savage
(74) *Attorney, Agent, or Firm*—Randall J. Knuth

(57) ABSTRACT

A method for forming an oxidation-passive layer having high corrosion resistance to highly oxidizing materials such as ozone; a stainless steel and a titanium base alloy having corrosion resistance to an ozone containing fluid; and a fluid containing part, a process apparatus, and a fluid feed/discharge system made by using the same. The method comprises the steps of heat-treating the surface of a stainless steel or titanium-base alloy having an Al content of 0.5 percent by weight to 7 percent by weight either at 300° C. to 700° C. in a mixed gas atmosphere composed of an inert gas and 500 ppb to 1 percent $H_2O$ gas or 1 ppm to 500 ppm oxygen gas, or alternatively at 20° C. to 300° C. in a mixed gas atmosphere composed of an oxygen gas and at least 100 ppm ozone gas to form an oxidation-passive layer containing an aluminum oxide or a titanium oxide.

36 Claims, 10 Drawing Sheets

METHOD FOR FORMING OXIDATION-PASSIVE LAYER, FLUID-CONTACTING PART, AND FLUID FEED/DISCHARGE SYSTEM

BACKGROUND OF THE INVENTION

1. Field of the Invention

The present invention relates to a method for forming an oxidation passive layer, to a fluid-contacting part, and to a fluid feed system. In greater detail, the present invention relates to a method for forming an oxidation passive layer having a layer chiefly comprising aluminum oxides on the surface of stainless steel, a method for forming an oxidation passive layer chiefly comprising titanium oxides on a titanium base alloy surface, stainless steel or titanium base alloy having such passive layers formed thereon, and a fluid-contacting part and fluid feed system having parts in contact with a fluid (gas or liquid) employing these stainless steel and titanium materials.

2. Description of the Related Art

Chromium oxide passive layers are highly resistant to corrosion by various semiconductor manufacturing process gases. Moreover, the outgassing properties thereof are extremely superior, allowing such layers to be employed in vacuum devices, reduced-pressure devices, and gas supply pipes which require a high degree of cleanliness. These chromium oxide passive layers may also be used in supply pipes for ultrapure water and the like.

Recently, the high oxidizing power of ozone has been used in various technologies, such as cleaning of silicon substrate, ashing, and low-temperature CVD oxidation to develop highly efficient and integrated device.

However, in ozone supply piping materials, fluorine resins such as PVDF or the like, which are commonly employed in wet systems, and SUS316 and the like, which is commonly employed in gas systems, are markedly corroded by ozone. This represents a source of contamination, so that it is impossible to use such materials. Furthermore, as the ozone concentration increases, even the oxidation of the chromium oxide passive layers described above from $Cr_2O_3$ to $CrO_3$ occurs as a result of the oxidizing power of the ozone. Therefore, it becomes impossible to maintain a high state of cleanliness in the piping and the atmosphere and the like.

In light of the above circumstances, the present invention has as an object thereof to provide a method for forming an oxidation passive layer which is highly resistant to corrosion by strongly oxidizing substances such as ozone.

Furthermore, it is an object of the present invention to provide stainless steel and titanium base alloys which are strongly resistant to corrosion by fluids containing ozone, as well as to provide fluid-contacting parts, process apparatuses, and fluid feed systems and discharge systems employing these corrosion resistent materials.

SUMMARY OF THE INVENTION

In a method for forming oxidation passive layers of the present invention, a stainless steel surface containing Al in an amount within a range of 0.5 percent by weight to 7 percent by weight is heat treated at a temperature within a range of 300° C. to 700° C. in a mixed gas atmosphere of an inert gas and 500 ppb to 1 percent $H_2O$ gas, and thereby, an oxidation passive layer containing aluminum oxides is formed.

Furthermore, in another method for forming oxidation passive layers in accordance with the present invention, a stainless steel surface containing Al in an amount within a range of 0.5 percent by weight to 7 percent by weight is polished to a Rmax of 0.7 micrometers or less, and baked in an inert gas atmosphere, whereby moisture is removed from the surface of the stainless steel, and subjected to heat treatment at a temperature within a range of 300° C. to 700° C. in a mixed gas atmosphere of an inert gas and 500 ppb to 1 percent $H_2O$ gas, and thereby, an oxidation passive layer containing aluminum oxides is formed.

In another method for forming oxidation passive layers in accordance with the present invention, a stainless steel surface containing Al in an amount within a range of 0.5 percent by weight to 7 percent by weight is subjected to heat treatment at a temperature within a range of 300° C. to 700° C. in a mixed gas atmosphere of an inert gas and 1 ppm to 500 ppm of oxygen gas, and thereby, an oxidation passive layer containing aluminum oxides is formed.

In another method for forming oxidation passive layers in accordance with the present invention, a stainless steel surface containing Al in an amount within a range of 0.5 percent by weight to 7 percent by weight is polished to a Rmax of 0.7 micrometers or less, and then, baked in an inert gas atmosphere, whereby moisture is removed from the stainless steel surface, and then heat treatment is conducted at a temperature within a range of 300° C. to 700° C. in a mixed gas atmosphere of an inert gas and 1 ppm to 500 ppm of oxygen gas, and thereby, an oxidation passive layer containing aluminum oxides if formed.

In the present invention, it is preferable that hydrogen gas be added to the mixed gas in an amount of 10 percent or less.

In another method for forming oxidation passive layers in accordance with the present invention, a stainless steel surface containing Al in an amount within a range of 0.5 percent by weight to 7 percent by weight is heat treated at a temperature within a range of 20° C. to 300° C. in a mixed gas atmosphere containing oxygen gas and at least 100 ppm of ozone gas, and thereby, an oxidation passive layer containing aluminum oxides is formed.

In a further method for forming oxidation passive layers in accordance with the present invention, a stainless steel surface containing Al in an amount within a range of 0.5 percent by weight to 7 percent by weight is polished to a Rmax of 0.7 micrometers or less, and baked in an inert gas atmosphere, whereby moisture is removed from the stainless steel surface, and then this is subjected to heat treatment at a temperature within a range of 20° C. to 300° C. in a mixed gas atmosphere containing oxygen gas and at least 100 ppm of ozone gas, and thereby, an oxidation passive layer containing aluminum oxides is formed.

In a further embodiment, it is characteristic that nitrogen gas is added in an amount of 10 percent or less to the mixed gas containing ozone gas as described above.

In the methods for forming oxidation passive layers in accordance with the present invention, it is preferable that the amount of Al contained in the stainless steel be within a range of 3 percent by weight to 6 percent by weight.

Additionally, in yet another embodiment, it is characteristic that the oxidation passive layer chiefly comprises a mixed oxide layer of aluminum oxides and chromium oxides.

In another method for forming oxidation passive layers in accordance with the present invention, a titanium base alloy surface is heat treated at a temperature within a range of 300° C. to 700° C. in a mixed gas atmosphere of an inert gas and 500 ppb to 1 percent $H_2O$ gas, and thereby, an oxidation passive layer comprising titanium oxides is formed.

In a further method for forming oxidation passive layers in accordance with the present invention, a titanium base alloy surface is polished to a Rmax of 0.7 micrometers or less, and baked in an inert gas atmosphere, whereby moisture is removed from the titanium base alloy surface, and then heat treatment is conducted at a temperature within a range of 300° C. to 700° C. in a mixed gas atmosphere of an inert gas and 500 ppb to 1 percent $H_2O$, and thereby, an oxidation passive layer comprising titanium oxides is formed.

In another method for forming oxidation passive layers in accordance with the present invention, a titanium base alloy surface is heat treated at temperature within a range of 300° C. to 700° C. in a mixed gas atmosphere of an inert gas and 1 ppm to 500 ppm of oxygen gas, and thereby, an oxidation passive layer comprising titanium oxides is formed.

In a further method for forming oxidation passive layers in accordance with the present invention, a titanium base alloy surface is polished to a Rmax of 0.7 micrometers or less, and baked in an inert gas atmosphere, whereby moisture is removed from the surface of the stainless steel, and subsequently, by heat treatment at a temperature within a range of 300° C. to 700° C. in a mixed gas atmosphere of an inert gas and 1 ppm to 500 ppm of oxygen gas, thereby an oxidation passive layer comprising titanium oxides is formed. In the above heat treatment, it is preferable that hydrogen gas be in an amount of 10 percent or less.

In another method for forming oxidation passive layers in accordance with the present invention, a titanium base alloy surface is subjected to heat treatment at temperature within a range of 20° C. to 300° C. in a mixed gas atmosphere of oxygen gas and 100 ppm or more of ozone gas, and thereby, an oxidation passive layer comprising titanium oxides is formed.

In another method for forming oxidation passive layers in accordance with the present invention, a titanium base alloy surface is polished to a Rmax of 0.7 micrometers or less and baked in an inert gas atmosphere, whereby moisture is removed from the titanium base alloy surface, and heat treatment is conducted at a temperature within a range of 20° C. to 300° C. in a mixed gas atmosphere of oxygen gas and 100 ppm or more ozone gas, thereby an oxidation passive layer comprising titanium oxides is formed. In a further embodiment, 10 percent or less of nitrogen gas is added to the mixed gas.

In the present invention, the titanium base alloy contains 99 percent by weight or more of Ti, or alternatively, contains 99 percent by weight or more of Ti, 0.05 percent by weight or less of Fe, 0.03 percent by weight or less of C, 0.03 percent by weight or less of Ni, 0.03 percent by weight or less of Cr, 0.005 percent by weight or less of H, 0.05 percent by weight or less of O, and 0.03 percent by weight or less of N.

The stainless steel of the present invention has an oxidation passive layer having a thickness of 3 nm or more and chiefly containing aluminum oxides at the outermost surface thereof. Alternatively, an oxidation passive layer having a thickness of 3 nm or more and chiefly comprising aluminum oxides at the outermost surface is formed on a surface polished to a Rmax of 0.7 micrometers or less.

The amount of Al contained in the stainless steel is preferably within a range of 0.5 percent by weight to 7 percent by weight, and more preferably within a range of 3 percent by weight to 6 percent by weight.

The passive layer comprises mixed oxides of, chiefly, aluminum oxides and chromium oxides.

The titanium base alloy of the present invention has an oxidation passive layer having a thickness of 3 nm or more and comprising titanium oxides at the outermost surface formed thereon. Alternatively, an oxidation passive layer having a thickness of 3 nm or more and comprising titanium oxides at the outermost surface thereof is formed on a surface polished to a Rmax of 0.7 micrometers or less.

The titanium base alloy contains 99 percent or more of Ti, or alternatively, contains 99 percent or more of Ti, 0.05 percent by weight or less of Fe, 0.03 percent by weight or less of C, 0.03 percent by weight or less of Ni, 0.03 percent by weight or less of Cr, 0.005 percent by weight or less of H, 0.05 percent by weight or less of O, and 0.03 percent by weight or less of N.

The fluid-contacting part of the present invention has parts in contact with fluid which comprises stainless steel or titanium base alloy in accordance with the present invention.

The process apparatus of the present invention has parts in contact with fluid which comprise stainless steel or titanium base alloy in accordance with the present invention.

The fluid feed system of the present invention has parts in contact with fluid which comprise stainless steel or titanium base alloy in accordance with the present invention.

The fluid feed system of the present invention has parts in contact with fluid which comprise stainless steel or titanium base alloy in accordance with the present invention.

The discharge system of the present invention has parts in contact with fluid which comprise stainless steel or titanium base alloy in accordance with the present invention.

A method for forming oxidation passive layers on stainless steel will be explained as an example of a method for forming oxidation passive layers in accordance with the present invention.

The stainless steel employed contains 0.5 percent by weight to 7 percent by weight of Al. At amounts of less than 0.5 percent, a passive layer having high corrosion resistance cannot be formed, and if the amount is in excess of 7 percent, intermetallic oxides are formed and it is impossible to obtain a stable passive layer. It is particularly preferable that the amount of Al contained be within a range of 3 percent by weight to 6 percent by weight, and in this range, the aluminum oxide component ratio is further increased, and it is possible to form an oxidation passive layer having superior corrosion resistance with respect to ozone.

It is preferable that the surface of the stainless steel be polished so as to achieve a surface roughness Rmax of 0.7 micrometers or less, using electropolishing, composite electropolishing, polishing with polishing granules, buff polishing, or the like. By making the surface smooth, it is possible to reduce the amount of emitted gas, to increase the adhesion, and to suppress the generation of particulate matter so as to form a minute oxide layer. When the surface roughness is reduced, it becomes more difficult to form an oxidation passive layer, so that the surface roughness may be determined along with the formation temperature, the atmospheric concentration, the time, and the like, in accordance with the desired layer thickness and layer characteristics.

The following first through third oxidation methods are encompassed in the oxidation method of the present invention.

First, the first method is one in which heat treatment (300° to 700° C.) is conducted in an inert gas atmosphere containing a trace amount of moisture (500 ppb to 1 percent).

In the present method, as the moisture concentration increases, there is a tendency for the passive layer formation speed to increase. If the amount of moisture is less than 500 ppb, it is difficult to form a passive layer having aluminum oxide as a chief component thereof. Furthermore, the layer formation rate is extremely slow, so that this is not suitable for practical application. On the other hand, if the amount of moisture is in excess of 1 percent, although this is also related to the generation temperature, it becomes difficult to form a minute passive layer having a high degree of resistance to ozone.

As the heat treatment temperature increases, the rate of layer formation increases. At temperatures lower than 300° C., there is almost no formation of the passive layer and practical application is impossible. At temperatures in excess of 700° C., surface irregularities are produced, and the resistance to ozone also decreases. Therefore, the heat treatment temperature is set within a range of 300° C. to 700° C.

It is preferable that hydrogen gas be added to the inert gas, as described above, in an amount of 10 percent or less, and particularly preferably in an amount of 3 percent to 10 percent. By adding the hydrogen gas, it is possible to reduce the proportion of iron oxide in the oxidation passivation layer, and to form a passive layer having greater resistance to ozone.

The second oxidation method is one in which heat treatment (300° C. to 700° C.) is conducted in an inert gas atmosphere containing a trace amount (1 ppm to 500 ppm) of oxygen.

As the oxygen concentration increases, there is a tendency for the rate of generation of the passive layer to increase, and in the same manner as in the first method described above, in order to efficiently obtain a passive layer having a high degree of resistance to ozone, it is necessary that the oxygen concentration be within a range of 1 ppm to 500 ppm. Furthermore, for the same reason as in the first method, it is preferable that hydrogen gas be added to the inert gas in an amount of 10 percent or less.

The third method is one in which treatment (20° C. to 300° C.) is conducted in the presence of oxygen containing at least 100 ppm of ozone.

In this method, it is possible to produce an oxidation passive layer at low temperatures, and moreover, it is possible to form an oxidation passive layer having high resistance to ozone. Oxygen gas containing 100 ppm or more of ozone may be obtained by subjecting pure oxygen gas or a gas containing oxygen gas to an electric discharge by means of silent discharge. In such a case, it is preferable that 10 percent or less of nitrogen gas (preferably within a range of 4 percent to 6 percent) be admixed.

If the treatment temperature is in excess of 300° C., the ozone will break down and the iron oxide component will increase, and the resistance to ozone will decrease. Therefore, this temperature is set at 300° C. or below. Furthermore, if the treatment temperature is reduced to approximately room temperature, the formation of the layer is dramatically slowed, so that it is preferable to set the ozone concentration at, for example, 7 percent.

In the first through third methods described above, prior to conducting oxidation treatment, it is preferable that the surface to be subjected to oxidation treatment be polished to a Rmax of 0.7 micrometers or less in advance, and that this then be subjected to baking in an inert gas atmosphere (preferably within a range of 200° C. to 600° C.). By means of this preprocessing, the cleanliness of the layer is increased, and the resistance to ozone is further increased.

Next, a method for forming oxidation passive layers on a titanium base alloy will be explained.

Fundamentally, this is identical to the case in which stainless steel is employed. In other words, heat treatment is conducted in an inert gas atmosphere containing a trace amount (500 ppb to 1 percent) of moisture or a trace amount (1 ppm to 500 ppm) of oxygen, and thereby, it is possible to form an oxidation passive layer having high resistance to ozone which has titanium oxides as the chief component thereof.

Ti occludes hydrogen gas and becomes brittle, so that normally Ti is not brought into contact with hydrogen. However, in the present invention, event if 10 percent or less of hydrogen is added when the Ti is oxidized, the titanium does not become brittle as a result of the hydrogen. On the contrary, a minute and strong passive layer is formed.

Furthermore, if treatment (at 20° C. to 300° C.) employing oxygen gas containing at least 100 ppm of ozone is carried out as well, it is possible to form an oxidation passive layer having high resistance to ozone which has titanium oxides as the chief component thereof.

Examples of inert gases which were preferably employed in the present invention include, for example, $N_2$ gas, Ar gas, and the like.

The stainless steel of the present invention has a oxidation passive layer having a thickness of 3 nm or more chiefly comprising aluminum oxides at the outermost surface thereof. Stainless steel having an oxidation passive layer containing chiefly aluminum oxides of a thickness of 3 nm exhibits extremely high resistance to ozone. It is preferable that the oxidation passive layer containing chiefly aluminum oxides and having a thickness of 3 nm be formed on a stainless steel surface having a Rmax of 0.7 micrometers or less; the resistance to ozone corrosion of such stainless steel is further increased.

The stainless steel base material of the present invention contains Al in an amount within a range of 0.5 percent by weight to 7 percent by weight, and more preferably within a range of 3 percent by weight to 6 percent by weight. By employing such stainless steel, it is easily possible to form an oxidation passive layer having aluminum oxides as a chief component thereof and having a thickness of 3 nm or more.

The titanium base alloy of the present invention has an oxidation passive layer having a thickness of 3 nm or more and chiefly comprising titanium oxides at the outermost surface thereof. The titanium base alloy having a 3 nm oxidation passive layer containing chiefly titanium oxides exhibits extremely high resistance to corrosion with respect to ozone. It is preferable that the oxidation passive layer containing chiefly titanium oxides and having a thickness of 3 nm be formed on the surface of stainless steel having a Rmax of 0.7 micrometers or less, whereby, the resistance to corrosion by ozone of such stainless steel is further increased.

The titanium base alloy of the present invention preferably contains Ti in an amount of 99 percent by weight or greater. More preferably, this titanium base alloy contains the further impurities of Fe in an amount of 0.05 percent by weight or less, C in an amount of 0.03 percent by weight or less, Ni in an amount of 0.03 percent by weight or less, Cr in an amount of 0.03 percent by weight or less, H in an amount of 0.005 percent by weight or less, O in an amount of 0.05 percent by weight or less, and N in an among of 0.03 percent by weight or less. By employing such a titanium base alloy, it is easily possible to form an oxidation passive layer having titanium oxides as a chief component thereof and having a thickness of 3 nm or more.

The oxidation passive layer formed in accordance with the present embodiment described above has anti-corrosive properties with respect to corrosive gases such as hydrogen chloride gas or the like, and has outgassing characteristics, which are superior, similarly to those of chromium oxide passive layers. In addition, such layers are extremely stable even with respect to fluids containing strongly oxidizing substances such as ozone. Accordingly, the stainless steel or titanium base alloy of the present invention may be used in process apparatuses such as vacuum or depressurized apparatuses, which require a highly clean atmosphere; as fluid-contacting parts of various types of gas or ultrapure water supply pipe systems, such as valves, filters, junctions, and the like; and in discharge systems, such as fluid feed systems, pumps, and the like. In addition, the stainless steel or titanium base alloy may be appropriately employed even with respect to cases in which fluids are employed which contain ozone and the like. Furthermore, it is a simple matter to employ the stainless steel of the present invention as material for lines having a diameter of few micrometers, and furthermore, an oxidation passive layer may be formed on the surface thereof, so that use in gas filters and the like is particularly appropriate.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

In embodiment one of the present invention, the austenitic stainless steels (SA7 through SA9) having an Al content of approximately 5 percent by weight shown in Table 1 were electropolished, and the surface roughness Rmax thereof was set to 0.3 micrometers.

TABLE 1

| | Ni | Cr | Al | C | Si | Mn | P | S | Mo | Cu | Nb | N |
|---|---|---|---|---|---|---|---|---|---|---|---|---|
| SA7 | 26.02 | 18.70 | 5.29 | 0.018 | 0.12 | 0.16 | 0.018 | <0.001 | 0.01 | 0.01 | 0.20 | 0.026 |
| SA8 | 31.07 | 18.60 | 5.15 | 0.018 | 0.12 | 0.16 | 0.017 | <0.001 | <0.01 | 0.01 | 0.20 | 0.022 |
| SA9 | 35.87 | 18.33 | 5.11 | 0.015 | 0.12 | 0.15 | 0.015 | <0.001 | 0.01 | 0.01 | 0.18 | 0.019 |
| SUS316L | 15.10 | 17.15 | — | 0.001 | 0.01 | 0.01 | 0.004 | 0.001 | 2.76 | — | — | 0.0073 |

The samples described above (SA7, 8, 9) were inserted into an oxidizing treatment furnace, and the temperature within was raised from room temperature to 600° C. in a period of 30 minutes while introducing Ar gas having an impurity concentration of 1 ppb into the furnace, and baking was conducted for a period of one hour at this temperature, and the moisture adhering to the surface of the sample was removed.

After the completion of baking, the temperature was maintained and the gas was switched to a treatment gas in which 10 percent hydrogen gas and 100 ppm of moisture were present in an Ar gas atmosphere, and heat treatment was conducted for a period of 6 hours.

Figure 1A:
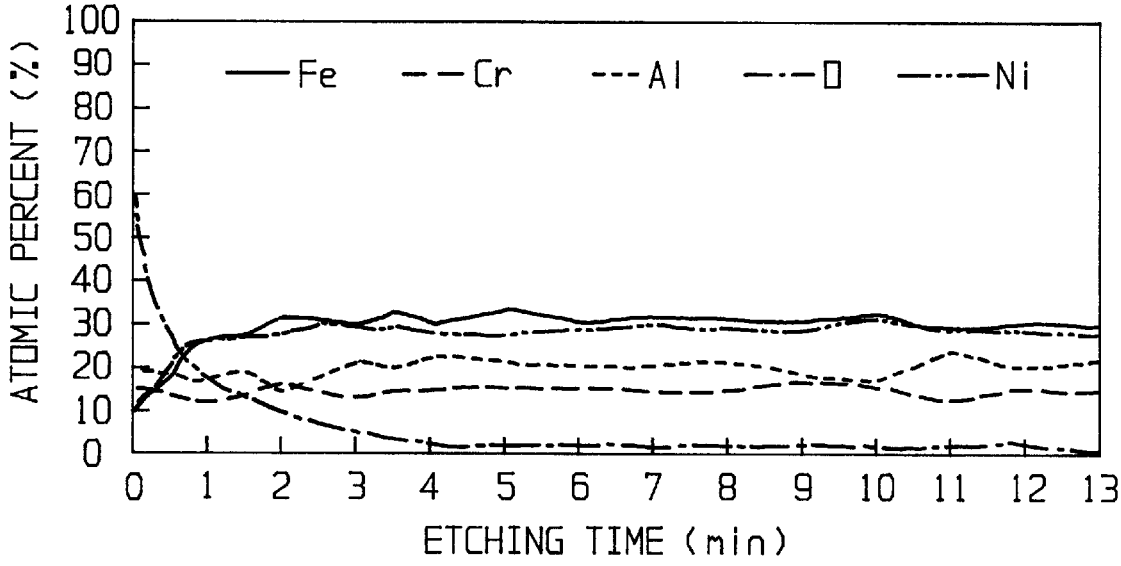
FIG. 1 is a graph showing the profile in the direction of depth of the constituent atoms of an oxidation passive layer on stainless steel.
Figure 1B:
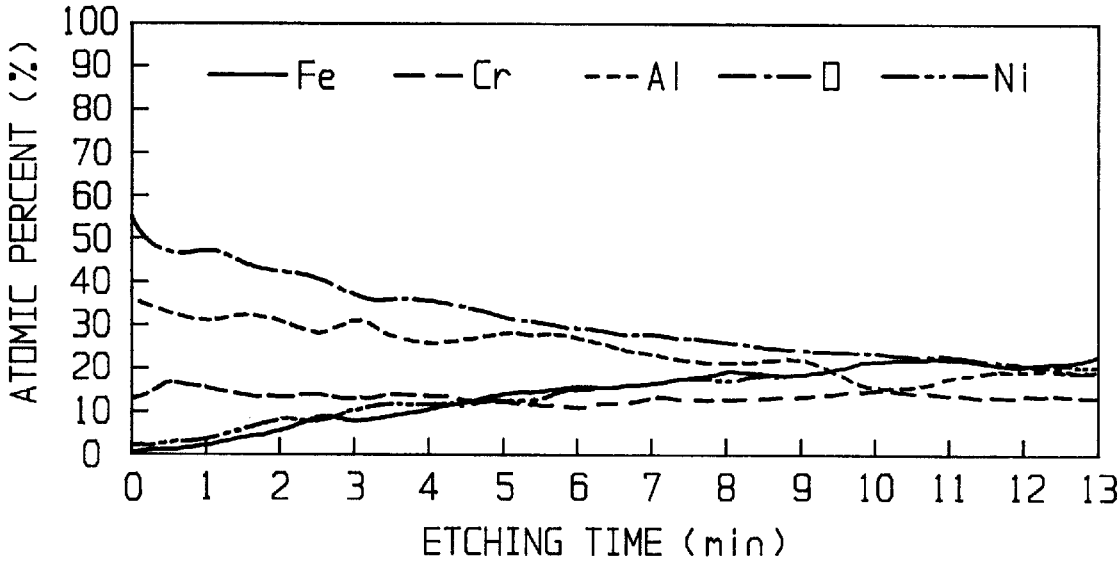
Figure 2A:
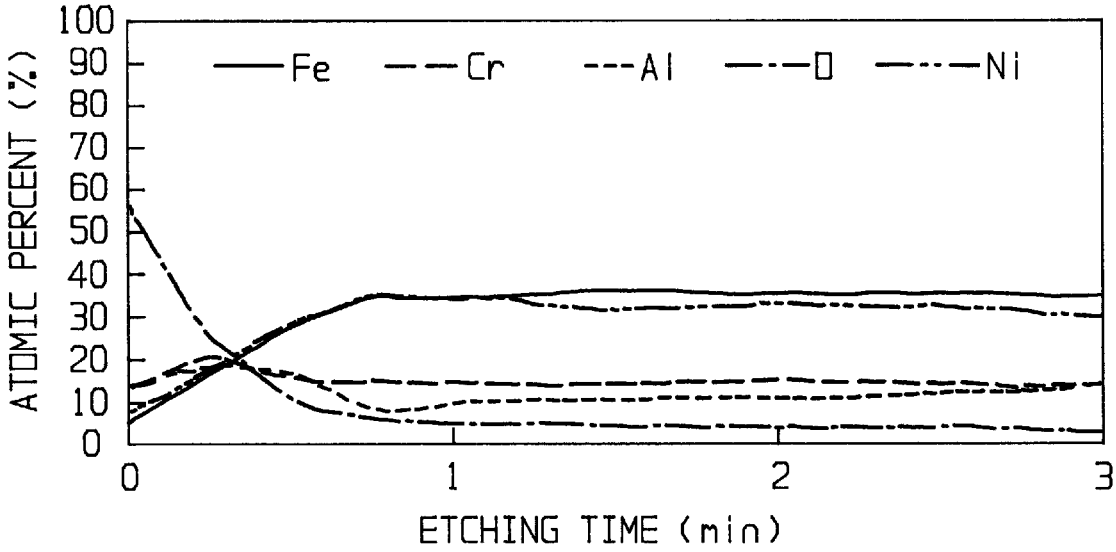
FIG. 2 is a graph showing the relationship between the profile in the direction of depth of the constituent atoms of an oxidation passive layer on stainless steel and the oxidation temperature.
Figure 2B:
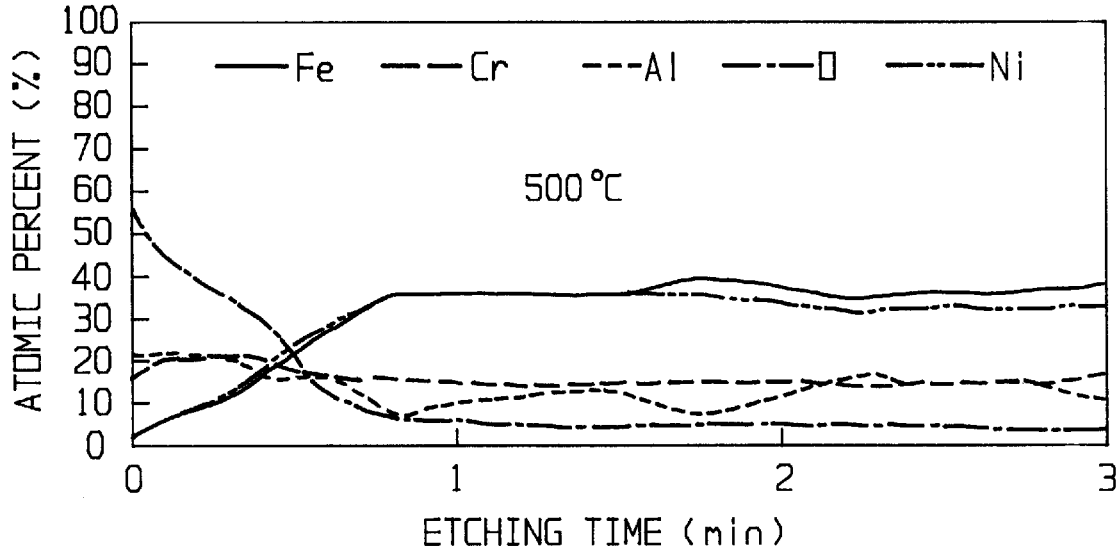
Figure 2C:
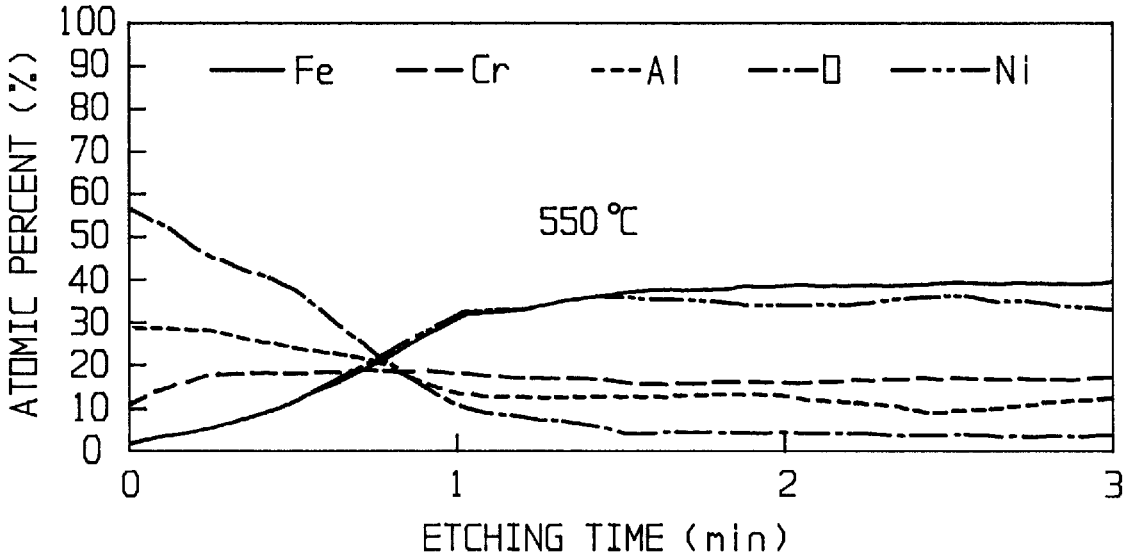
Figure 2D:
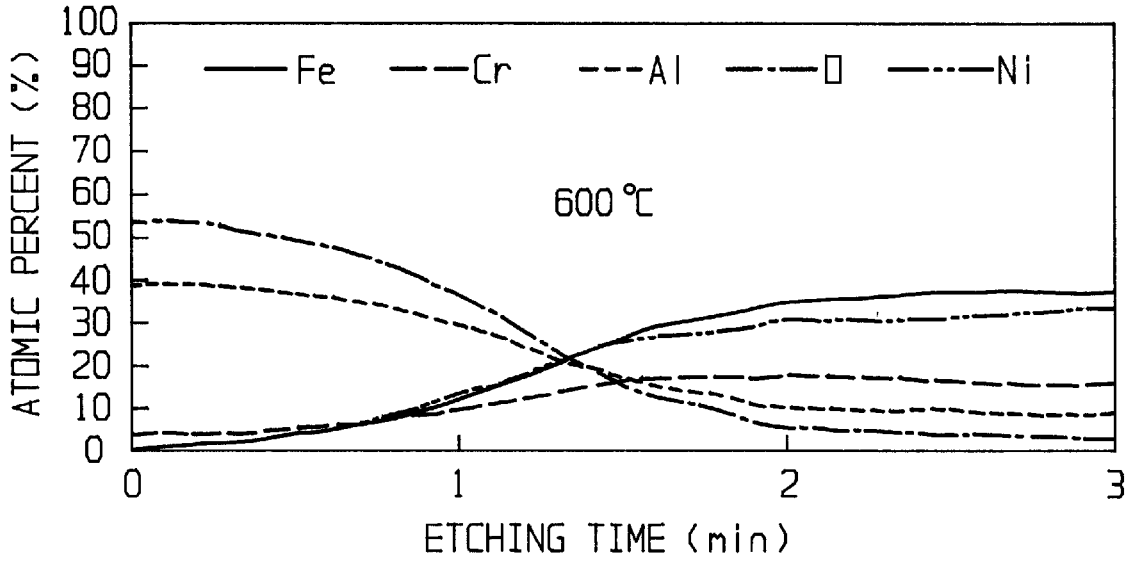
Figure 3A:
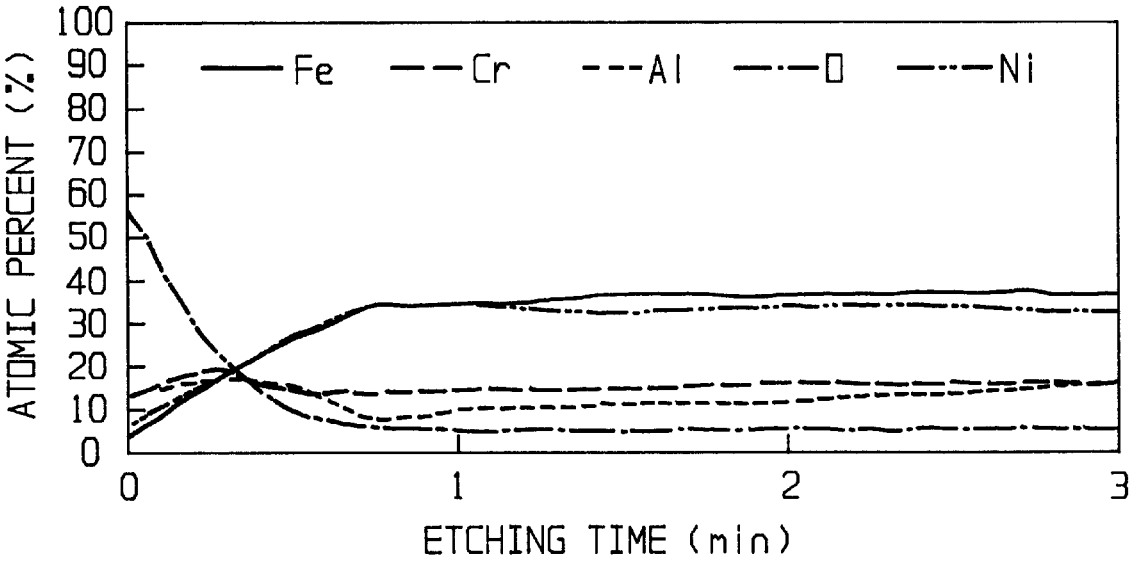
FIG. 3 is a graph showing the relationship between the profile in the direction of depth of the constituent atoms of an oxidation passive layer on stainless steel and the moisture concentration used for oxidation.
Figure 3B:
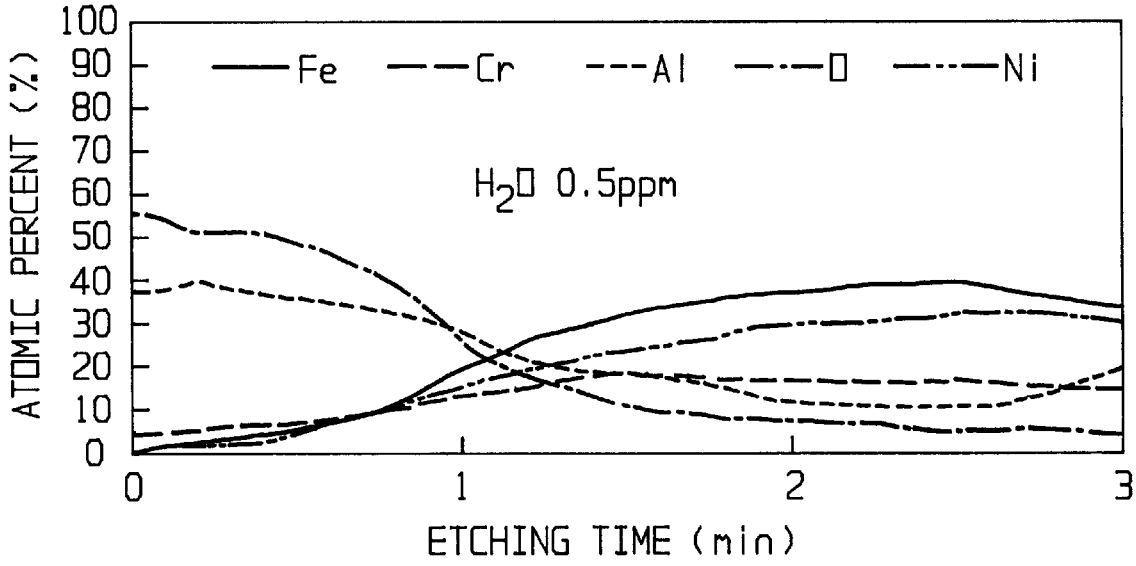
Figure 3C:
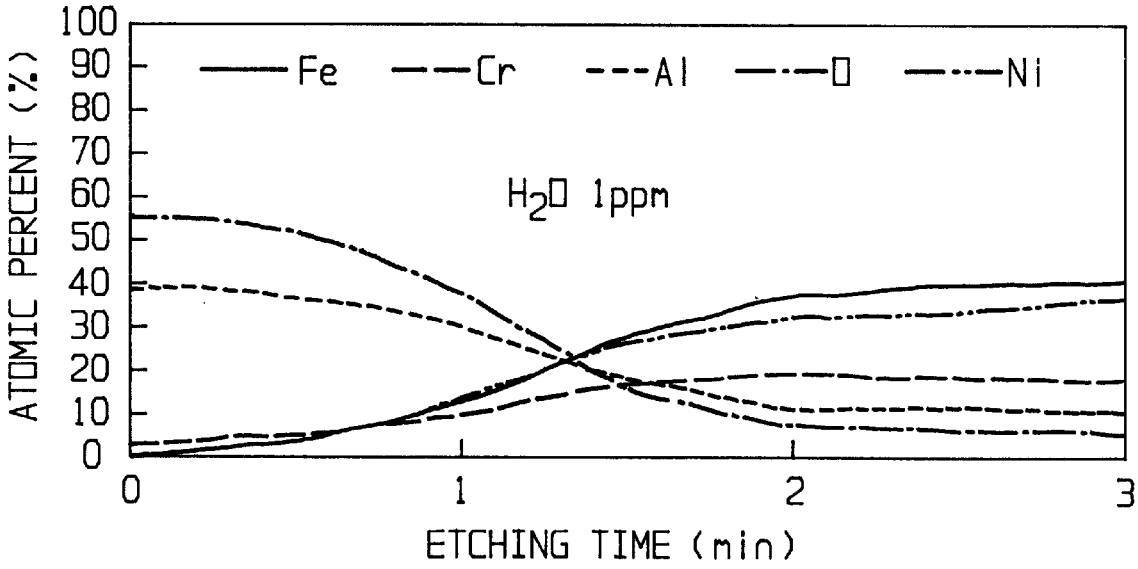
Figure 3D:
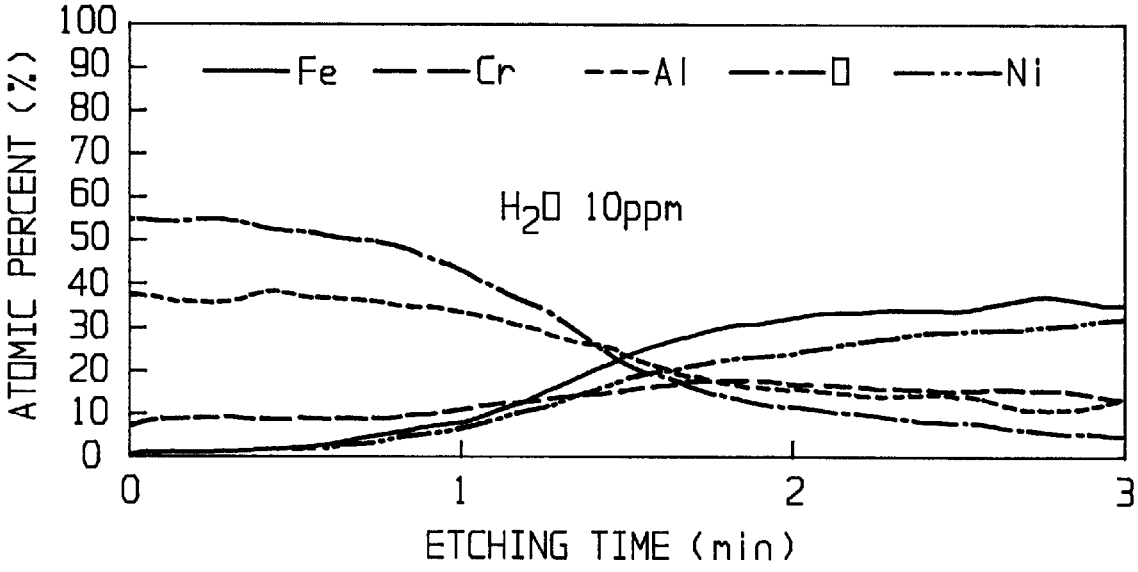

FIGS. 1(*a*) and (*b*) show ESCA analyses before and after oxidation passive layer formation treatment using SA8 as an example. In the figures, the vertical axis indicates the composition of each constituent atom, while the horizontal axis indicates the etching time by means of ions, which corresponds to the depth of the surface. Here, the etching rate was 7.0 nm/min in silicon conversion.

Although not shown in the figures, essentially identical results were obtained for SA7 and SA9.

As is clear from FIGS. 1(*a*) and (*b*), the surface of the stainless steel treated in accordance with the conditions described above has a passive layer comprising chiefly aluminum oxides formed thereon to a depth of approximately 60 nm. The thickness of the passive layer is, in FIGS. 1(*a*) and (*b*), the intersection point between Al and Fe.

In embodiment two of the present invention, an SA8 sample was treated in the manner of embodiment one, with the exception that the moisture concentration was set to 1 ppm and the temperature of the oxidation treatment was varied in a number of ways, and oxidation passive layers were formed. An example of the ESCA analyses measured with respect to a sample of the oxidation passive layers formed is shown in FIG. 2. In FIG. 2, (a) indicates the state before treatment, (b) indicates treatment at 500° C., (c) indicates treatment at 550° C., and (d) indicates treatment at 600° C.

As is clear from FIG. 2, as the treatment temperature increases, the thickness of the layer in which Al oxides predominate increases. Although not shown in the figures, irregularities occurred to the surface of the passive layer when the temperature exceeded 600° C., and when the temperature was in excess of 700° C., these irregularities were pronounced. On the other hand, at 300° C., although the qualities of the layer remain essentially unchanged, the rate of growth of the passive layer was slowed, and was one-tenth that of the case in which a temperature of 500° C. was employed.

In embodiment three of the present invention, a SA7 sample was subjected to oxidation passive layer formation under oxidation conditions identical to those of embodiment one, with the exception that the moisture concentration was varied. The ESCA analyses are shown in FIG. 3 with respect to a portion of the samples of the passive layers formed. In FIG. 3, (a) indicates the state prior to treatment, (b) indicates treatment at 0.5 ppm, (c) indicates treatment at 1 ppm, and (d) indicates treatment at 10 ppm.

As can be seen from FIGS. 3(*a*) through (*d*), as the moisture concentration increased, the thickness of the passive layer also increased.

In embodiment four of the present invention, the oxidation passive layer of the embodiment 1 (SA7) and a chromium oxide oxidation passive layer were evaluated for resistance to ozonated ultrapure water.

The chromium oxide passive layer was formed by oxidation using a method absolutely identical to that of embodiment one using SUS316L having the composition shown in Table 1, and when the profile in the depth direction of the chromium oxide passive layer was measured By ESCA, it was determined that a passive layer comprising chromium oxide was formed with a depth of 20 nm.

In the evaluation method, a sample was immersed in ultrapure water containing an ozone concentration of 2 ppm. After immersion, the sample was removed, and an observation of the surface was conducted, whereupon it was determined that the chromium oxide passive layer disappeared after three days, while the aluminum oxide passive layer of embodiment one remained unchanged after 10 days. An observation using scanning electron microscopy confirmed that there was absolutely no change in the surface.

In embodiment five of the present invention, the stainless steel indicated by SA7 of Table 1 was inserted into an oxidation treatment furnace, and the temperature therewithin was raised from room temperature to 600° C. over a period of 30 minutes while introducing Ar gas having an impurity concentration of 1 ppb into the furnace, baking was conducted for a period of one hour at this temperature, and the adsorbed moisture was removed from the surface of the sample.

After the completion of baking, the same temperature was maintained and the gas was exchanged from a treatment gas comprising 10 percent hydrogen gas and 1000 ppm of moisture in an Ar gas atmosphere, and heat treatment was conducted for a period of 6 hours.

Figure 4A:
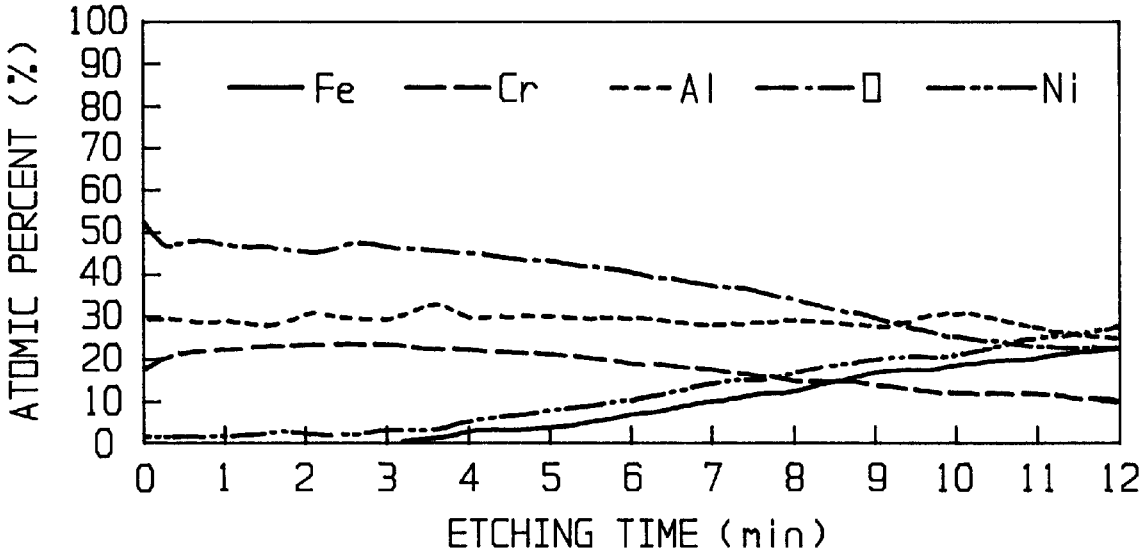
FIG. 4 is a graph showing the relationship between the profile in the direction of depth of the constituent atoms of a passive layer before and after impregnation in ozonated water.
Figure 4B:
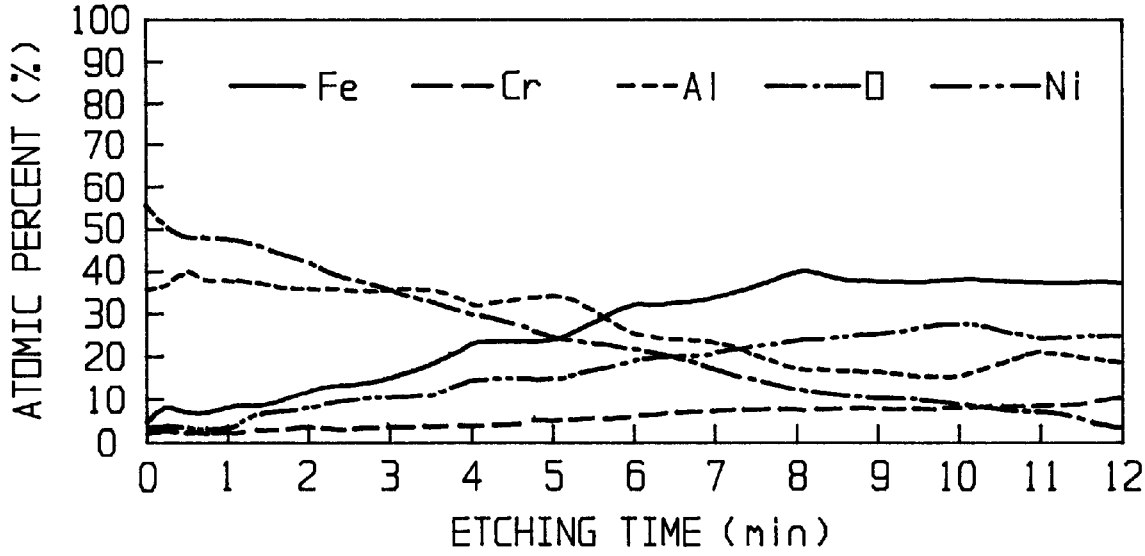

The SA7 having a passive layer formed thereon was immersed for a period of 10 days in water containing 3 ppm of ozone, and the surface was observed using scanning electron microscopy and ESCA before and after immersion. In the electron microscopy, no change was observed in the surface; however, it can be seen from the ESCA analyses before and after immersion which were shown in FIGS. 4(*a*) and (*b*) that there was some slight erosion of the passive layer.

In embodiment six of the present invention, stainless steel having the composition indicated by SA8 of Table 1 was introduced into an oxidation treatment furnace, the temperature therewithin was raised from room temperature to 550° C. over a period of 30 minutes while introducing Ar gas having an impurity concentration of 1 ppm into the furnace. This temperature was maintained while exchanging the gas for a treatment gas in which hydrogen gas was contained in an amount of 10 percent and moisture was contained in an amount of 10 ppm in an Ar gas atmosphere. Heat treatment was conducted for a period of 6 hours.

Figure 5A:
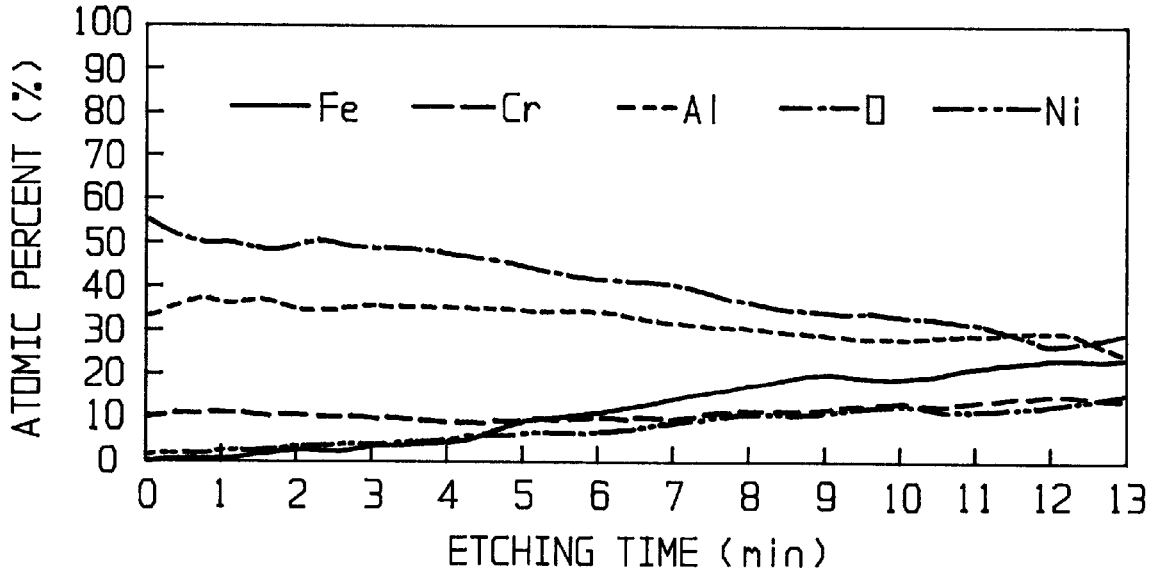
FIG. 5 is a graph showing the changes in the depth profile of the constituent atoms of a passive layer before and after exposure to ozone gas.
Figure 5B:
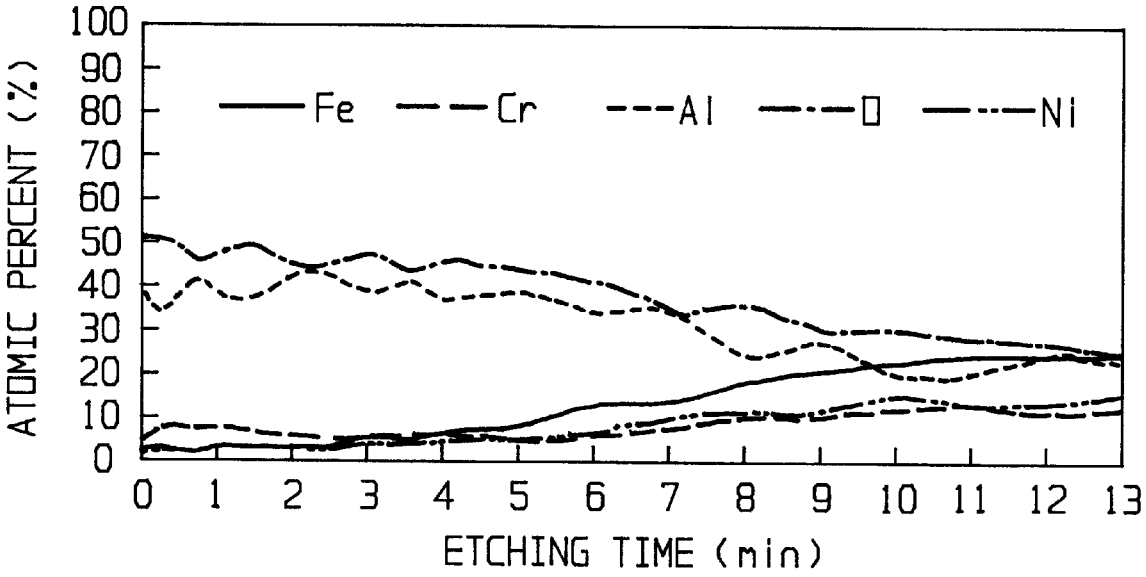

The SA7 having a passive layer formed thereon was subjected to a flow of oxygen containing 7 percent ozone gas at a rate of 1 L/min and at room temperature and the effect of the ozone gas was determined by means of ESCA. The results thereof are shown in FIG. 5. In FIG. 5, (*a*) indicates the state prior to ozone gas exposure, while (*b*) indicates the state after exposure.

As can be seen from FIGS. 5(*a*) and (*b*), the oxidation passive layer of the present embodiment was completely stable even with respect to a high concentration of ozone gas.

In embodiment seven of the present invention, stainless steel having the composition of SA8 was prepared, with the exception that the amount of Al contained was varied, and oxidation passive layers were formed in the manner of embodiment one, and the resistance to ozone and surface roughness thereof were evaluated. The results thereof are shown in Table 2.

TABLE 2

| Al (%) | 0.1 | 0.5 | 3 | 6 | 7 | 8 |
|---|---|---|---|---|---|---|
| Ozone Resistance | X | ≧ | ○ | ○ | ○ | ○ |
| Surface Roughness | ≧ | ○ | ○ | ○ | ≧ | X |

From Table 2, it can be seen that when the amount of Al contained was within a range of 3 percent by weight to 6 percent by weight, and both the resistance to ozone and the surface roughness were superior.

In embodiment eight of the present invention, SA8 was inserted into an oxidation treatment furnace, the temperature therewithin was raised from room temperature to 600° C. over a period of 30 minutes while introducing Ar gas having an impurity concentration of 1 ppb into the furnace, and baking was conducted at this temperature for a period of one hour to remove adsorbed moisture from the sample surface.

After the conclusion of baking, this temperature was maintained, and oxygen gas was introduced at a concentration of 1 ppm, 10 ppm, and 500 ppm, and 10 percent hydrogen gas was introduced into the Ar atmosphere, and heat treatment was conducted for a period of 6 hours.

When the oxidation passive layer was observed by means of ESCA, it was confirmed that oxidation passive layers having aluminum oxides as the chief component thereof were formed at thicknesses of 7 nm, 10 nm, and 20 nm, respectively.

In embodiment 9 of the present invention, SA8 was introduced into an oxidation treatment furnace, the temperature therewithin was raised from room temperature to 100° C. over a period of 10 minutes while introducing Ar gas having an impurity concentration of 5 ppb into the furnace, and oxygen gas (containing 4 percent nitrogen gas) containing ozone in an amount of 100 ppm was introduced from an ozone generating apparatus (the SG-01AH produced by Sumitomo Seimitsu Kogyo K. K.), and this was subjected to oxidation treatment for a period of 6 hours.

When the oxidation passive layer was observed by means of ESCA, it was determined that an oxidation passive layer having aluminum oxides as a chief component thereof was formed to a thickness of 10 nm.

In embodiment ten of the present invention, the Ti material contained 99 percent by weight of Ti, and as impurities, contained 0.05 percent by weight of Fe, 0.03 percent by weight of C, 0.03 percent by weight of Ni, 0.03 percent by weigh of Cr, 0.005 percent by weight of H, 0.05 percent by weight of O, and 0.03 percent by weight of N, and this was polished using polishing granules and the surface roughness Rmax thereof was set to 0.7 micrometers.

The sample described above was inserted into an oxidation treatment furnace, and the temperature therewithin was raised from room temperature to 500° C. over a period of 30 minutes while introducing Ar gas having an impurity concentration of 1 ppb into the furnace, baking was conducted at this temperature for a period of one hour, and the adsorbed moisture was removed from the sample surface. After the completion of baking, the temperature was maintained and the gas was exchanged for a treatment gas in which hydrogen gas was contained in an amount of 10 percent and moisture was contained in an amount of 100 ppm in a Ar gas atmosphere, and heat treatment was conducted for a period of one hour.

Figure 6A:
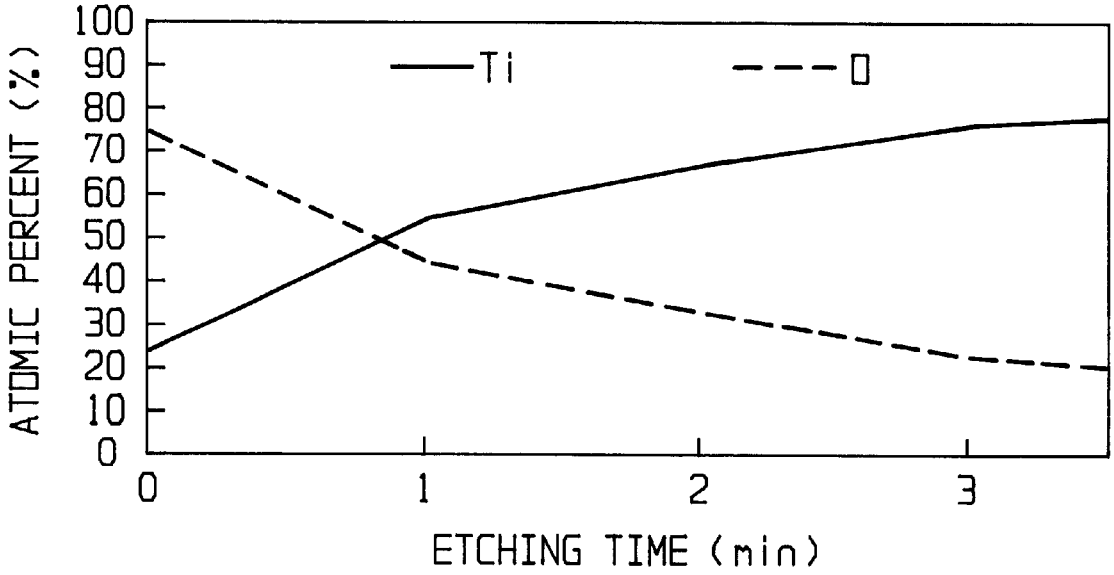
FIG. 6 is a graph showing the changes in the depth profile of the constituent atoms before and after oxidation passive layer treatment of a titanium base alloy.
Figure 6B:
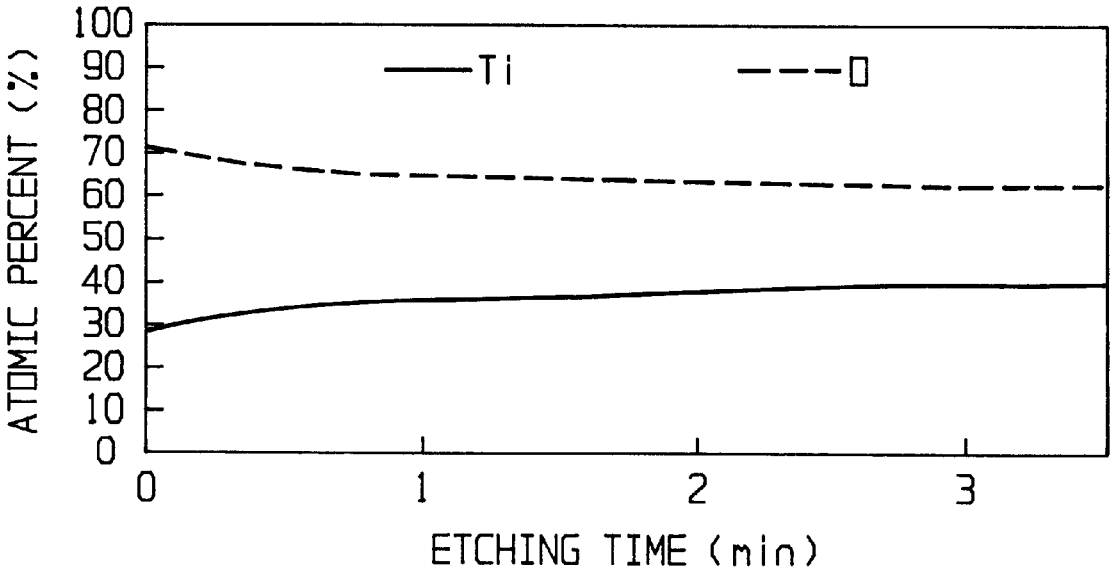

FIGS. 6(*a*) and (*b*) show ESCA analyses before and after treatment. As shown in FIG. 6, the surface of the titanium material treated under the conditions described above had a passive layer comprising titanium oxides formed thereon, and the thickness thereon was found to be 50 nm. The etching rate was 7 nm/second in silicon conversion.

Figure 7A:
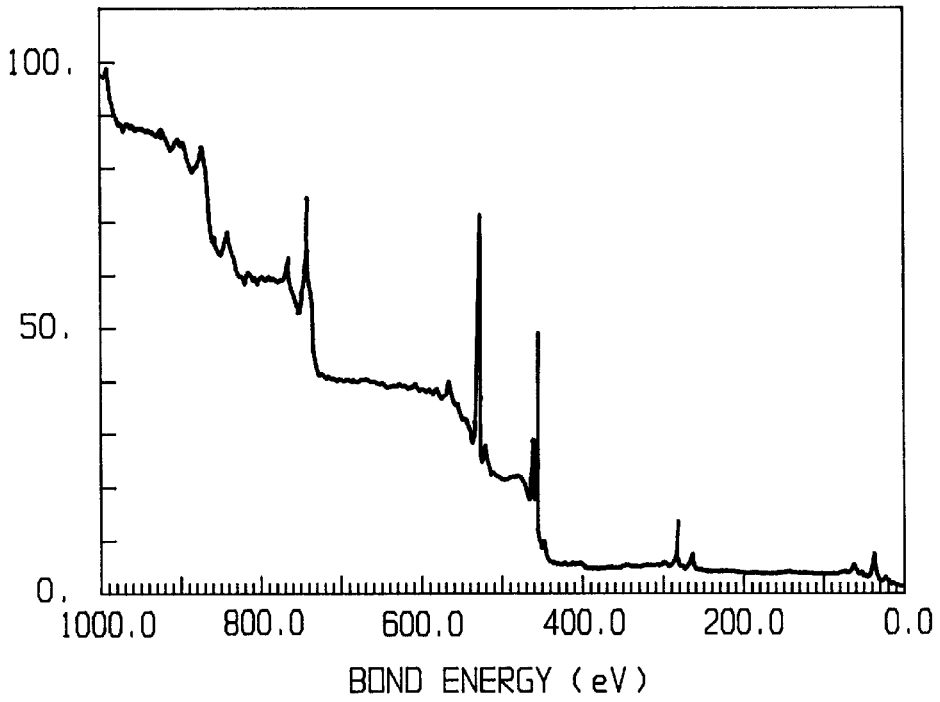
FIG. 7 shows the ESCA spectra of a titanium oxide sintered body and an oxidation passive layer.
Figure 7B:
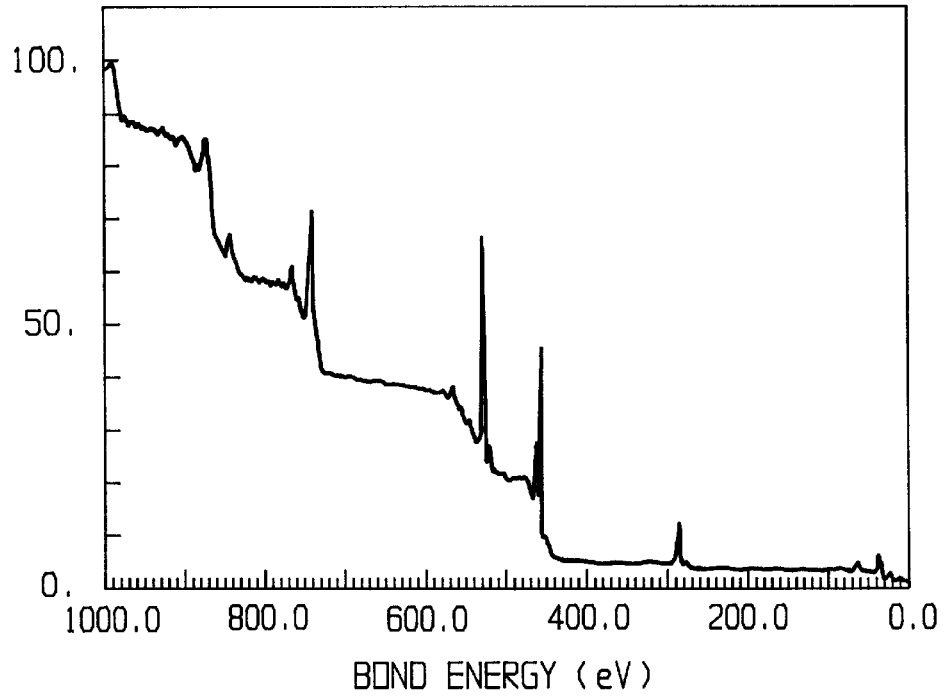

Furthermore, in FIG. 7, the ESCA spectrum (b) of the oxidation passive layer and the spectrum (a) of the titanium oxide sintered body are compared. As is clear from FIGS. 7(*a*) and (*b*), the titanium oxide of the oxidation passive layer formed in the present embodiment is essentially the same as that of the titanium oxide sintered body.

Figure 8A:
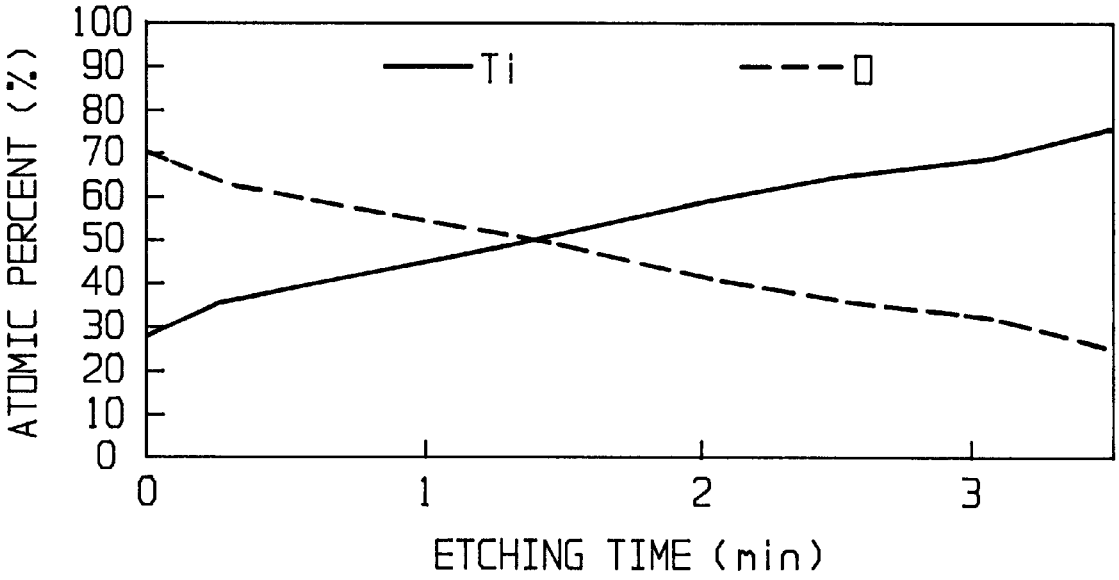
FIG. 8 is a graph showing the changes in the depth profile of the constituent atoms before and after impregnation in ozonated water.
Figure 8B:
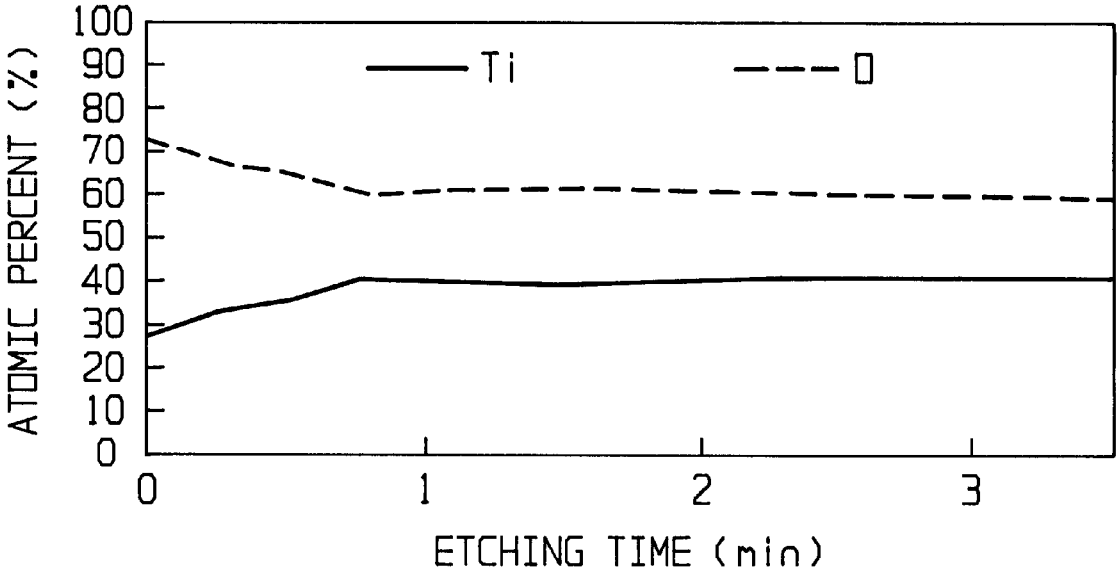

Next, the oxidation passive layer formed in the present embodiment was immersed for a period of one month in water containing 12 ppm of ozone together with untreated titanium material. ESCA analyses before and after immersion are shown in FIG. 8.

It can be seen that the titanium material itself was deeply oxidized in comparison with the state prior to immersion, and furthermore, in the case of the oxidation passive layer, the same profile was observed to an etching time of 3.5 minutes, and it can thus be seen that the surface did not change as a result of immersion.

In embodiment eleven of the present invention, the Ti material employed in embodiment ten was inserted into an oxidation treatment furnace, the temperature therewithin was raised from room temperature to 500° C. while introducing Ar gas having an impurity concentration of 5 ppb into the furnace, baking was conducted at this temperature for a period of one hour, and the adsorbed moisture was removed from the surface of the sample.

After the conclusion of baking, this temperature was maintained, and oxygen gas was introduced into the Ar atmosphere at concentrations of 1 ppm, 10 ppm, and 500 ppm, and 10 percent hydrogen gas was introduced, and heat treatment was conducted for a period of one hour.

When the oxidation passive layers were observed by means of ESCA, it was determined that oxidation passive layers comprising titanium oxides were formed having depths of 10 nm, 20 nm, and 70 nm, respectively.

In embodiment twelve of the present invention, the Ti material employed in embodiment ten was introduced into an oxidation treatment furnace, the temperature therewithin was raised from room temperature to 100° C. over a period of 10 minutes while introducing Ar gas having an impurity concentration of 5 ppm into the furnace, and oxygen gas (containing 5 percent nitrogen gas) containing 100 ppm of ozone was introduced from an ozone generating apparatus (the SG-01AH produced by Sumitomo Seimitsu Kogyo K. K.), and heat treatment was conducted for a period of 6 hours.

When the oxidation passive layer was observed by means of ESCA, it was determined that an oxidation passive layer comprising titanium oxide having a thickness of 40 nm was formed.

By means of the forming method for oxidation passive layers in accordance with the present invention, an oxidation passive layer having aluminum oxides as a chief component thereof can be easily and stably formed on stainless steel or alternatively, and oxidation passive layer comprising titanium oxides can be easily and stably formed on a titanium base alloy.

The oxidation passive layer formed in accordance with the present invention is stable with respect to strongly oxidizing substances such as ozone and the like.

Accordingly, it is possible to provide the stainless steel and titanium base alloy of the present invention as stable and highly clean materials for feed systems and treatment apparatuses for washing and ozone gas treatment and the like which employ ozone. The stainless steel and titanium alloy of the present invention have applications in the manufacturing processes of highly functional and highly integrated devices.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for forming oxidation passive layers, comprising;

subjecting stainless steel containing Al in an amount within a range of 0.5 percent by weight to 7 percent by weight to heat treatment within a range of 300° C. to 700° C. in a mixed gas atmosphere of an inert gas and oxygen gas in an amount within a range of 1 ppb to 500 ppm, thereby forming an oxidation passive layer containing aluminum oxides on a surface of the stainless steel.

2. The method for forming oxidation passive layers according to claim 1, wherein the mixed gas further comprises hydrogen gas in an amount of 10 percent or less.

3. The method for forming oxidation passive layers according to claim 2, wherein the amount of Al contained in the stainless steel is within a range of 3 percent by weight to 6 percent by weight.

4. The method for forming oxidation passive layers according to claim 1, wherein the amount of Al contained in the surface of stainless steel is within a range of 3 percent by weight to 6 percent by weight.

5.The method for forming oxidation passive layers according to claim 1, wherein the oxidation passive layer comprises a mixed oxide layer of aluminum oxides and chromium oxides.

6. A method for forming oxidation passive layers, comprising:

polishing a surface of stainless steel containing Al in an amount within a range of 0.5 percent by weight to 7 percent by weight to achieve a Rmax of 0.7 micrometers or less;

baking the stainless steel in an inert gas atmosphere, thereby removing moisture from the surface of the stainless steel; and subjecting the stainless steel to heat treatment at a temperature within a range of 300° C. to 700° C. in a mixed gas atmosphere of an inert gas and oxygen in an amount within a range of 1 ppb to 500 ppm, thereby forming an oxidation passive layer containing aluminum oxides on the surface of the stainless steel.

7. A method for forming oxidation passive layers, comprising:

subjecting stainless steel containing Al in an amount within a range of 0.5 percent by weight to 7 percent by weight to heat treatment within a range of 20° C. to 300° C. in a mixed gas atmosphere of oxygen gas and 100 ppm of ozone gas, thereby forming an oxidation passive layer containing aluminum oxides on a surface of said stainless steel.

8. The method for forming oxidation passive layers according to claim 7, wherein the mixed gas further comprises nitrogen gas in an amount of 10 percent or less.

9. The method for forming oxidation passive layers according to claim 7, wherein the amount of Al contained in the stainless steel is within a range of 3 percent by weight to 6 percent by weight.

10. The method for forming oxidation passive layers according to claim 7, wherein the oxidation passive layer comprises a mixed oxide layer of aluminum oxides and chromium oxides.

11. A method for forming oxidation passive layers, comprising:

polishing a surface of stainless steel containing Al in an amount within a range of 0.5 percent by weight to 7 percent by weight to achieve an Rmax of 0.7 micrometers or less;

baking the stainless steel in an inert gas atmosphere, thereby removing moisture from the surface of the stainless steel; and subjecting the stainless steel to heat treatment at a temperature within a range of 20° C. to 300° C. in a mixed gas atmosphere of oxygen gas and 100 ppm of ozone gas, thereby forming an oxidation passive layer containing aluminum oxides on the surface of the stainless steel.

12. A method for forming oxidation passive layers, comprising:

polishing a surface of a titanium base to achieve a Rmax of 0.7 $\mu$m or less;

baking the titanium base alloy in an inert gas atmosphere, thereby removing moisture from the surface of the titanium base alloy; and subjecting the titanium base alloy to heat treatment at a temperature within a range of 300° C. to 700° C. in a mixed gas atmosphere of an inert gas and $H_2O$ in an amount within a range of 500 ppb to 1 percent, thereby forming an oxidation passive layer comprising titanium oxides.

13. A method for forming oxidation passive layers, comprising:

a subjecting a surface of a titanium base alloy to heat treatment within a range of 300° C. to 700° C. in a mixed gas atmosphere of an inert gas and oxygen gas in an amount within a range of 1 ppb to 500 ppm, thereby forming an oxidation passive layer comprising titanium oxides.

14. The method for forming oxidation passive layers according to claim 13, wherein the titanium base alloy contains Ti in an amount of 99 percent by weight or more, Fe in an amount of 0.05 percent by weight or less, C in an amount of 0.03 percent by weight or less, Ni in an amount of 0.03 percent by weight or less, Cr in an amount of 0.03 percent by weight or less, H in an amount of 0.005 percent by weight or less, O in an amount of 0.05 percent by weight or less, and N in an amount of 0.03 percent by weight or less.

15. A method for forming oxidation passive layers, comprising:

polishing a surface of titanium base alloy to achieve a Rmax of 0.7 micrometers or less;

baking the titanium base alloy in an inert gas atmosphere, thereby removing moisture from the surface of the titanium base alloy; and subjecting the titanium base alloy surface to heat treatment at a temperature within a range of 300° C. to 700° C. in a mixed gas atmosphere of an inert gas and oxygen in an amount within a range of 1 ppb to 500 ppm, thereby forming an oxidation passive layer comprising titanium oxides.

16. A method for forming oxidation passive layers, comprising:

subjecting a surface of titanium base alloy to heat treatment within a range of 20° to 300° C. in a mixed gas atmosphere of oxygen gas and 100 ppm of ozone gas, thereby forming an oxidation passive layer comprising titanium oxides.

17. The method for forming oxidation passive layers according to claim 16, wherein the mixed gas further comprises hydrogen gas in an amount of 10 percent or less.

18. The method for forming oxidation passive layers according to claim 16, wherein the titanium base alloy contains Ti in an amount of 99 percent by weight or more.

19. The method for forming oxidation passive layers according to claim 16, wherein the titanium base alloy contains Ti in an amount of 99 percent by weight or more, Fe in an amount of 0.05 percent by weight or less, C in an amount of 0.03 percent by weight or less, Ni in an amount of 0.03 percent by weight or less, Cr in an amount of 0.03 percent by weight or less, H in an amount of 0.005 percent by weight or less, O in an amount of 0.05 percent by weight or less, and N in an amount of 0.03 percent by weight or less.

20. A method for forming oxidation passive layers, comprising:

polishing a surface of a titanium base alloy to achieve a Rmax of 0.7 micrometers or less;

baking the titanium base alloy in an inert gas atmosphere, thereby removing moisture from the surface of the titanium base alloy; and subjecting the titanium base alloy to heat treatment at a temperature within a range of 20° C. to 300° C. in a mixed gas atmosphere of oxygen gas and 100 ppm of ozone gas, thereby forming an oxidation passive layer containing titanium oxides.

21. The method for forming oxidation passive layers according to claim 20, wherein the mixed gas further comprises hydrogen gas in an amount of 10 percent or less.

22. The method for forming oxidation passive layers according to claim 20, wherein the titanium base alloy contains Ti in an amount of 99 percent by weight or more, Fe in an amount of 0.05 percent by weight or less, C in an amount of 0.03 percent by weight or less, Ni in an amount of 0.03 percent by weight or less, Cr in an amount of 0.03 percent by weight or less, H in an amount of 0.005 percent by weight or less, O in an amount of 0.05 percent by weight or less, and N in an amount of 0.03 percent by weight or less.

23. A stainless steel component comprising:

stainless steel having an oxidation passive layer, said oxidation passive layer having a thickness or 3 nm or more, said being polished to a Rmax of 0.7 micrometers or less prior to formation of said oxidation passive layer thereon; and said oxidation passive layer having an outermost surface composed of aluminum oxides.

24. The stainless steel component according to claim 23 wherein the stainless steel contains Al in an amount within a range of 0.5 percent by weight and 7 percent by weight.

25. The stainless steel component according to claim 24 wherein the stainless steel contains Al in an amount within a range of 3 percent by weight and 6 percent by weight.

26. The stainless steel component according to claim 23 wherein said oxidation passive layer comprises a mixed oxide layer of aluminum oxides and chromium oxides.

27. The stainless steel composite according to claim 23, further comprising:

a fluid supply system in contact with ozone, said fluid supply system composed of said stainless steel.

28. The stainless steel composite according to claim 23, further comprising:

a fluid-contacting portion in contact with ozone, said fluid-contacting portion composed of said stainless steel.

29. A titanium base alloy component comprising:

titanium base alloy having an oxidation passive layer, said oxidation passive layer having a thickness of 3 nm or more; and said oxidation passive layer having an outermost surface composed of titanium oxides components.

30. The titanium base alloy component according to claim 29 wherein said outermost surface is polished to a Rmax of 0.7 micrometers or less prior to formation of said oxidation passive layer thereon.

31. The titanium base alloy component according to claim 29 wherein the titanium base alloy contains Ti in an amount of 99 percent by weight or more.

32. The titanium base alloy component according to claim 29 wherein the titanium base alloy contains Ti in an amount of 99 percent by weight or more, Fe in an amount of 0.05 percent by weight or less, C in an amount of 0.03 percent by weight or less, Ni in an amount of 0.03 percent by weight or less, Cr in an amount of 0.03 percent by weight or less, P in an amount of 0.005 percent by weight or less, O in an amount of 0.05 percent by weight or less, and N in an amount of 0.03 percent by weight or less.

33. The titanium base alloy composite according to claim 29, further comprising:

a fluid-contacting portion in contact with ozone, said fluid-contacting portion composed of said titanium base alloy.

34. A method for forming oxidation passive layers, comprising:

subjecting stainless steel containing Al in an amount within a range of 0.5 percent by weight to 7 percent by weight to heat treatment within a range of 300° C. to 700° C. in a mixed gas atmosphere of an inert gas and $H_2O$ gas in an amount within a range of 500 ppb to 1 percent, thereby, forming an oxidation passive layer containing aluminum oxides on a surface of said stainless steel.

35. The method for forming oxidation passive layers according to claim 34, wherein the mixed gas further comprises hydrogen gas in an amount of 10 percent or less.

36. A method for forming oxidation passive layers, comprising:

polishing a surface of stainless steel containing Al in an amount within a range of 0.5 percent by weight to 7 percent by weight to achieve a Rmax of 0.7 micrometers or less;

baking the stainless steel in an inert gas atmosphere, thereby removing moisture from the surface of the stainless steel; and subjecting the stainless steel to heat treatment at a temperature within a range of 300° C. to 700° C. in a mixed gas atmosphere of an inert gas and $H_2O$ in an amount within a range of 500 ppb to 1 percent, thereby forming an oxidation passive layer containing aluminum oxides on the surface of the stainless steel.

* * * * *